US011241662B2

(12) United States Patent
Følkner et al.

(10) Patent No.: US 11,241,662 B2
(45) Date of Patent: Feb. 8, 2022

(54) MULTIPHASE FLOW MIXING APPARATUS AND METHOD OF MIXING

(71) Applicant: FMC Kongsberg Subsea AS, Kongsberg (NO)

(72) Inventors: Stein Følkner, Østerås (NO); Magnus Smedsrud Bjørnstad, Oslo (NO)

(73) Assignee: FMG Kongsberg Subsea AS, Kongsberg (NO)

( * ) Notice: Subject to any disclaimer, the term of this patent is extended or adjusted under 35 U.S.C. 154(b) by 369 days.

(21) Appl. No.: 14/396,460

(22) PCT Filed: Jun. 6, 2013

(86) PCT No.: PCT/EP2013/061634
§ 371 (c)(1),
(2) Date: Oct. 23, 2014

(87) PCT Pub. No.: WO2014/005785
PCT Pub. Date: Jan. 9, 2014

(65) Prior Publication Data

US 2015/0092513 A1 Apr. 2, 2015

(30) Foreign Application Priority Data

Jul. 5, 2012 (NO) ..... 20120783

(51) Int. Cl.
*B01F 5/06* (2006.01)
*B01F 3/04* (2006.01)
(Continued)

(52) U.S. Cl.
CPC ..... *B01F 5/069* (2013.01); *B01F 3/0446* (2013.01); *B01F 3/0869* (2013.01);
(Continued)

(58) Field of Classification Search
CPC ..... B01F 5/069; B01F 3/0446; B01F 3/0876
(Continued)

(56) References Cited

U.S. PATENT DOCUMENTS 487,887 A 12/1892 Howell
517,159 A * 3/1894 Hartmann ..... B01F 11/0082 366/332
(Continued)

FOREIGN PATENT DOCUMENTS

CN 2601726 Y 2/2004
EP 0 065 685 A1 12/1982
(Continued)

*Primary Examiner* — Elizabeth Insler

(57) ABSTRACT

An apparatus and associated method for mixing at least a first fluid phase having a first density and a second fluid phase having a second density, the apparatus comprising; at least one container (1), the container comprising at least one inlet (2) for a multiphase flow and at least one outlet (3) at a lower axial end of the container (1), a hollow flow regulating device (4) axially arranged within the container (1), wherein a first end of the flow regulating device (4) is arranged in a distance from the outlet (3) providing a drainage gap (5) between the flow regulating device (4) and the outlet (3), which drainage gap (5) has a drainage area, the flow regulating device (4) comprising a number of perforations (6) along the axial length thereof and a discharge means (7) in a first end, which discharge means (7) opens towards the outlet (3), the flow regulating device (4) being connected to a position adjustment device (8), the position adjustment device (8) being arranged to move the flow regulating device (4) in the axial direction, thereby adjusting the drainage area of the drainage gap (5).

13 Claims, 1 Drawing Sheet

(51) Int. Cl.
*B01F 3/08* (2006.01)
*B01F 5/04* (2006.01)

(52) U.S. Cl.
CPC ..... *B01F 3/0876* (2013.01); *B01F 5/0426* (2013.01); *B01F 5/068* (2013.01); *B01F 5/0663* (2013.01)

(58) Field of Classification Search
USPC ..... 366/175.2, 332–335
See application file for complete search history.

(56) References Cited

U.S. PATENT DOCUMENTS 1,220,923 A * 3/1917 Wolfe ..... B01F 11/0082 366/332
2,954,144 A * 9/1960 Elam ..... B01F 11/0082 206/222
3,490,655 A * 1/1970 Ledgett ..... B01F 5/243 222/196
3,855,368 A * 12/1974 Prochazka ..... B01D 3/22 261/81
3,960,175 A 6/1976 Liepe et al.
4,737,349 A * 4/1988 Arnold ..... B01J 19/185 366/174.1
5,035,842 A 6/1991 Mohn
5,135,684 A 8/1992 Mohn et al.
5,711,338 A 1/1998 Talon
6,000,446 A * 12/1999 Wegman ..... B65B 37/00 141/129
6,200,014 B1 * 3/2001 Babenko ..... B01F 5/0451 366/167.1
8,708,049 B2 * 4/2014 Lawrence ..... E21B 49/088 166/100
2008/0140261 A1 * 6/2008 Hansen ..... B01F 3/02 700/282
2012/0276648 A1 * 11/2012 van Hal ..... C01G 1/12 436/119
2013/0188169 A1 * 7/2013 Harrison ..... G01N 21/85 356/36
2015/0092513 A1 * 4/2015 Folkner ..... B01F 5/0426 366/340

FOREIGN PATENT DOCUMENTS

EP 0 549 440 A1 6/1993
EP 2 425 890 A1 3/2012
WO WO 00/67018 A1 11/2000
WO WO 01/83074 A1 11/2001

* cited by examiner

MULTIPHASE FLOW MIXING APPARATUS AND METHOD OF MIXING

The invention relates to a subsea multiphase flow mixing apparatus, and an associated method, that includes a flow mixer having an inlet for a multiphase flow and an adjustable gas/liquid outlet.

BACKGROUND OF THE INVENTION

It is a common practice within the field of subsea fluid handling to allow the well flow from subsea wells to enter a flow mixer in order to mix or homogenize the well flow or production flow. This is normally performed in order to avoid gas/liquid slug flow and to provide stable operating conditions for the multiphase pump, which multiphase pump is arranged downstream of the flow mixer. The flow mixer breaks the energy of the slug flow, smoothes any fluctuations in the flow, and acts as a sand trap. A slug flow is normally referred to as a multiphase fluid flow regime characterized by a series of liquid plugs (slugs) separated by relatively large gas pockets. In vertical flow, the bubble is an axially symmetrical bullet shape that occupies almost the entire cross-sectional area of a tubing. The resulting flow alternates between high-liquid composition and high-gas composition.

A conventional subsea flow mixer is designed as an accumulator having a fixed flow restriction on the liquid outlet. The flow area of the restriction is set based on the expected well flow profile, e.g. production flow, and should prevent complete draining of the liquid during a gas slug, and overfilling during a liquid slug. The slug dampening effect of the flow mixer is dependent on the flow area of the restriction and the size and geometry of the flow mixer vessel.

A conservatively designed flow mixer, e.g. designed for the worst combination of nominal flow and slug during the life of the field, would result in a flow mixer having a physical size that is impractical for integration in a manifold or pump module. If the flow mixer is made smaller, the effective operating range is narrowed, and replacement may be required at some stage. Intervention costs relating to retrieval and re-installation of subsea modules, manifolds in particular, are significant.

From U.S. Pat. No. 5,035,842 it is known to feed a non-homogenous mixture of liquid and gas into a vessel to form a body of gas above a pool of liquid. Liquid is fed from the pool through a discharge pipe containing a constriction forming a venturi. Gas is drawn from the gas body through a pipe extending through the liquid pool into the discharge pipe to effect mixing of the liquid and the gas in the venturi. Perforations in the discharge pipe adjust the amounts of gas and liquid leaving the vessel to maintain both liquid and gas within the vessel.

U.S. Pat. No. 5,135,684 discloses a multiphase process mixing and measuring system. A liquid is supplied to a vessel to form a pool from which it discharges through a venturi. A supply pipe or pipes convey other liquids and/or gases from separate sources or from above the liquid pool into the venturi for nixing with the liquid. The supply pipes can extend through the pool and be perforated to tend to maintain the level of the pool. Associated with the venturi are pressure sensors for measuring flow and densitometer for permitting mass flow rate measurements of the gas and liquid phases. The apparatus can be incorporated in a cartridge for reception in a receptacle at a subsea installation.

An object of the invention is to adjust the flow of a gas and liquid in a mixing apparatus in situ, e.g. subsea, without retrieving the apparatus to the surface.

Another object of the invention is to be able to increase the liquid drainage area as part of a contingency plan to flush out sand and debris from the flow mixer.

SUMMARY OF THE INVENTION

The invention is set forth and characterized in the independent claims, while the dependent claims describe other characteristics of the invention.

The invention concerns an apparatus for mixing at least a first fluid phase having a first density and a second fluid phase having a second density. The apparatus comprises at least one container, the container comprising at least one inlet for a multiphase flow and at least one outlet at a lower axial end of the container, a hollow flow regulating device axially arranged within the container, wherein a first end of the flow regulating device is arranged at a distance from the outlet to provide a drainage gap between the flow regulating device and the outlet, which drainage gap has a drainage area. The flow regulating device comprises a number of perforations along the axial length thereof and a discharge means in a first end, which discharge means opens towards the outlet. The flow regulating device is connected to a position adjustment device which is arranged to move the flow regulating device in the axial direction, thereby adjusting the drainage area of the drainage gap. The flow regulating device is movable. In a preferred embodiment the first fluid phase is a liquid, while the second fluid phase is a gas.

In another embodiment, there may be arranged a first inlet, e.g. a liquid inlet, and a second inlet, e.g. a gas inlet, instead of one multiphase flow inlet.

There might be arranged one, two or a number of perforations along the axial length of the flow regulating device, the perforations extending along the circumference of the flow regulating device. The perforations might have any diameter that allows the liquid or gas to flow through them. A restriction in the number of perforations will slow down the liquid flow inside the container.

Depending on the multiphase well flow or production flow mixture entering the container, the drainage gap may be adjusted according to the well flow mixture. Moving the flow regulation device away from the outlet will result in a larger amount of liquid flowing out of the container. Correspondingly, by moving the flow regulating device towards the outlet, a larger amount of gas will flow out of the container. Another application of the invention might be to flush out sand or debris trapped at the outlet in the container. The sand or debris can be flushed by moving the flow regulation device away from the outlet, allowing the sand or debris to flush through the outlet.

The liquid, which due to gravity tends to collect in the lower part of the container closest to the outlet, draws along gas through the outlet and creates a gas/liquid mixture. This is due to a pressure difference between the inside of the container and downstream of the outlet outside the container. The pressure difference might be created by a narrowing, e.g. a venturi, by a pump, or by similar means well known to a person skilled in the art. The gas is drawn from the gas phase, i.e. the gas is normally in the upper part of the container, through the flow regulating device extending through the liquid and into the discharge means to effect mixing of the liquid and the gas through the outlet.

In an embodiment of the apparatus, the position adjustment device may be connected to a second end of the flow regulating device.

In another embodiment the multiphase flow separates into at least the first fluid phase and the second fluid phase in the container, the inlet and outlet being arranged such that the fluid phase having the largest density separates at the lower axial end closest to the outlet.

In an embodiment the container converges as an abutted cone at the outlet. The abutted cone may have a linear-shape, curve-shape, funnel-shape or throat-shape.

In an embodiment the diameter of the flow regulating device is substantially equal to the diameter of the outlet.

In another embodiment the position adjustment device comprises an external interface arranged on the outside of the container.

In an embodiment the external interface is configured to be manipulated by the means of a ROV manipulator, a torque tool, or an actuator wired to a subsea control system. The external interface might be in the form of a screw, bolt or any other interface suitable for manipulation by one of said means for manipulation. By manipulating the external interface, the position adjustment device is activated and the movable flow regulating device is moved in the axial direction such that the drainage gap, and thus the drainage area, between the lower axial end of the flow regulating device and the outlet, is modified. Depending on the mixture of the multiphase flow through the inlet, the drainage gap may be adjusted according to the mixture of the multiphase flow.

In an embodiment the apparatus may include measuring means for measuring the flow rates of the components in the multiphase flow, and, depending on the measured flow rates, one may adjust the drainage area by moving the flow regulating device in the axial direction thereof allowing more or less gas or liquid to flow through the outlet.

The invention also relates to a method of mixing at least a first fluid phase having a first density and a second fluid phase having a second density. The method comprising the steps of:

- providing at least one container, the container comprising at least one inlet for a multiphase flow and at least one outlet at a lower axial end of the container,
- arranging a hollow flow regulating device axially within the container, a first end of the flow regulating device is arranged in a distance from the outlet providing a drainage gap between the flow regulating device and the outlet, which drainage gap has a drainage area, the flow regulating device comprising a number of perforations along the axial length thereof and a discharge means in a first end, which discharge means opens towards the outlet,
- connecting the flow regulating device to a position adjustment device,
- adjusting the drainage area of the drainage gap by manipulating the position adjustment device.

The invention will now be described in non-limiting embodiments and with reference to the attached drawings, wherein;

DETAILED DESCRIPTION OF A PREFERENTIAL EMBODIMENT

Figure 1:
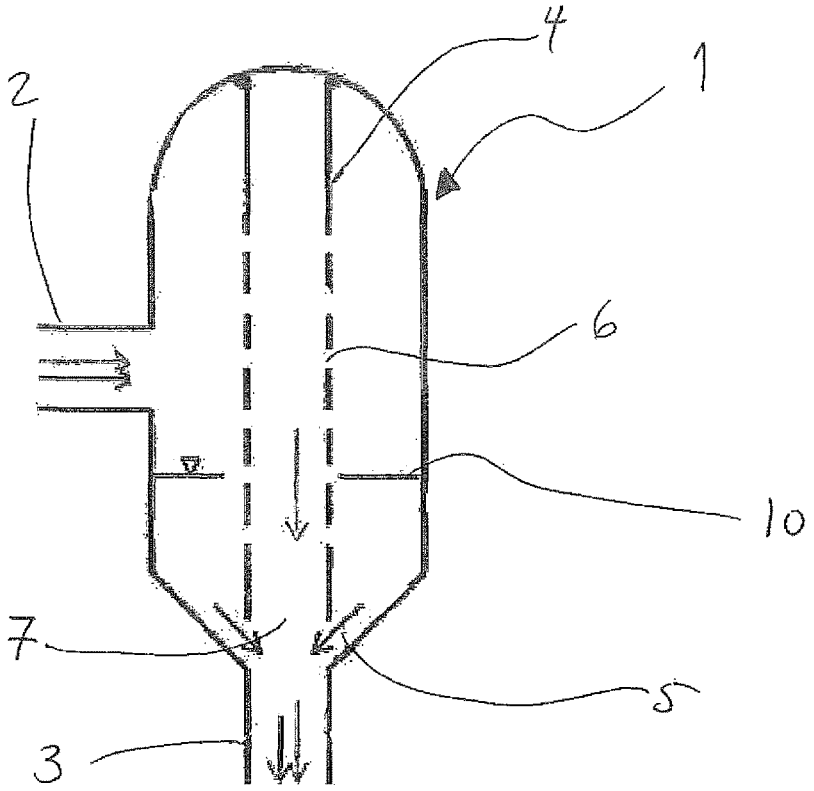
Fig 1 (prior art)
FIG. 1 shows an example of a mixing apparatus according to the prior art.

FIG. 1 shows an example of a mixing apparatus according to the prior art, where the mixing apparatus is exemplified as a container 1. The container 1 has an inlet 2 for a multiphase flow. The multiphase flow comprises a mixture of at least a first fluid phase having a first density, e.g. a liquid, and a second fluid phase having a second density, e.g. a gas. An outlet 3 is arranged at the lower axial end of the container 1. The liquid level inside the container 1 is shown as a gas-liquid interface 10. A hollow flow regulating device 4 is axially arranged inside the container 1. The flow regulating device 4 is connected at an upper part of the inner surface of the container 1 and extends a fixed distance towards the outlet 3. The flow regulating device 4 opens towards the outlet 3 through discharge means 7. Further, the flow regulating device 4 is provided with perforations 6 along its circumference, which perforations 6 extend along the axial length of the flow regulating device 4. A drainage gap 5 forms a fixed drainage area between the lower axial end of the flow regulating device 4 and the outlet 3. Multiphase flow entering through inlet 2 will, due to gravity, separate into a gas phase and a liquid phase inside the container 1, shown by the gas-liquid interface 10. The gas flows through the perforations 6 to the inside of the flow regulating device 4. The liquid, which due to gravity separates in the lower part of the container 1 closest to the outlet 3, draws out gas through the discharge means 7 and the mixed gas-liquid flow flows through the outlet 3 as a homogenous flow. This is due to a pressure difference between the inside of the container 1 and downstream of the outlet 3. The pressure difference might be created by a narrowing of the flow are e.g. a venturi (not shown), or by a pump creating a suction pressure.

Figure 2:
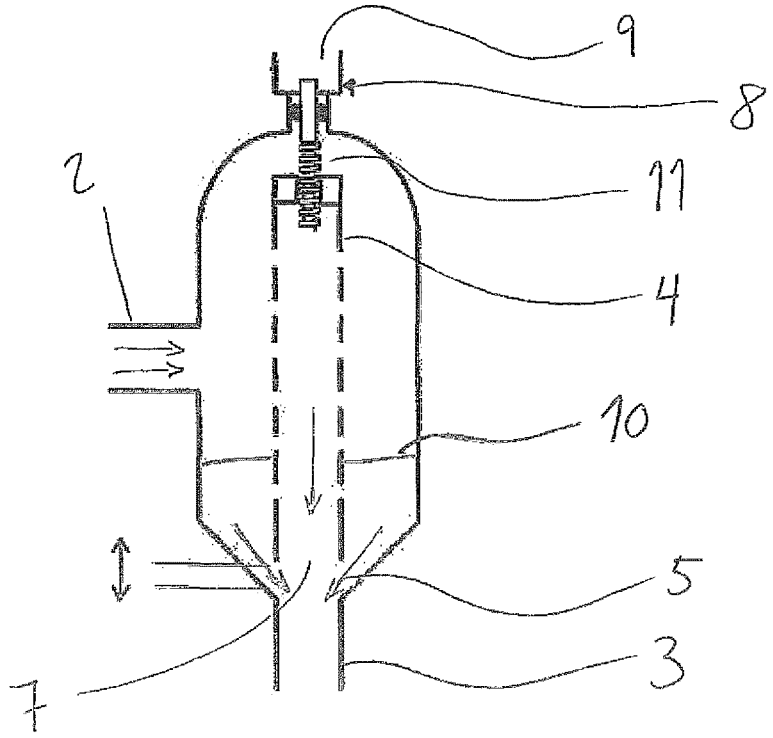
FIG. 2 shows an embodiment of the mixing apparatus according to the present invention.

FIG. 2 shows an embodiment of the mixing apparatus according to the present invention. Similar to FIG. 1 there is shown a container 1 having an inlet 2 for a multiphase flow. An outlet 3 is arranged at the lower axial end of the container 1. The liquid level inside the container 1 is shown as a gas-liquid interface 10, A hollow flow regulating device 4 is axially arranged inside the container 1. The flow regulating device 4 is connected to an adjustment device 8 in the upper axial end of the container, which adjustment device 8 comprises a flexible arrangement 11 and an external interface 9. The flow regulating device 4 opens towards the outlet 3 through discharge means 7. Further, the flow regulating device 4 is provided with perforations 6 along its circumference, which perforations 6 extend along the axial length of the flow regulating device 4. The external interlace 9 is arranged on the outside of the container 1 and can be manipulated from the outside. The external interface 9 might be in the form of a screw, bolt or any other interlace suitable for manipulation by a ROV manipulator, a torque tool or an actuator wired to a subsea control system (not shown). By manipulating the external interface 9 of the position adjustment device 8, the position adjustment device 8 causes the flow regulating device 4 to move in the axial direction such that the drainage gap 5, and thus the drainage area, between the lower axial end of the flow regulating device 4 and the outlet 3, is modified. Depending on the mixture of the multiphase flow through the inlet 2, the drainage gap 5 may be adjusted according to the multiphase flow mixture. Moving the flow regulation device 4 away from the outlet 3 will lead to a larger amount of liquid flowing out of the container 1. Correspondingly, by moving the flow regulating device 4 towards the outlet 3, a larger amount of gas will flow out of the container 3. In cases where sand or debris has gathered at the outlet 3, the flow regulating device 4 can be moved away from the outlet 3, allowing the sand or debris to be flushed out through the outlet 3.

By the use of the arrangement as described herein, one is able to adjust the amount of liquid and/or gas flowing out from the flow mixer through the outlet, and thus minimize slug flow.

The invention is herein described in non-limiting embodiments. A person skilled in the art will understand that there may be made alterations and modifications to the embodiments that are within the scope of the invention as described in the attached claims.

The invention claimed is:

1. A subsea multiphase flow mixing apparatus for mixing a multiphase flow comprising at least a liquid phase and a gas phase, the apparatus comprising:

at least one container which is configured to be disposed subsea and includes at least one inlet for the multiphase flow and at least one outlet located at a lower axial end of the container;

a hollow flow regulating device which is axially arranged within the container and includes a lower first end located an axial distance from the outlet to thereby provide an axially extending drainage gap between the lower first end of the flow regulating device and a top of the outlet, the drainage gap having a drainage area and the flow regulating device comprising a number of perforations along the axial length thereof and a discharge opening in the first end which opens towards the outlet; and a position adjustment device which is connected to the flow regulating device and is configured to selectively move the flow regulating device in the axial direction to selective stationary positions to thereby adjust the drainage area of the drainage gap;

wherein the position adjustment device comprises an external interface arranged on the outside of the container; and wherein the external interface is configured to be manipulated by an ROV manipulator or an actuator wired to a subsea control system.

2. The apparatus according to claim 1, wherein the position adjustment device is connected to an upper second end of the flow regulating device.

3. The apparatus according to claim 1, wherein during operation of the apparatus, the multiphase flow separates into at least the liquid phase and the gas phase in the container, and wherein the inlet and the outlet are arranged such that the liquid phase having the largest density separates at the lower axial end of the container, closest to the outlet.

4. The apparatus according to any of claims 1-3, wherein the container converges as an abutted cone at the outlet.

5. The apparatus according to any of claims 1-3, wherein the diameter of the flow regulating device is equal to the diameter of the outlet.

6. The apparatus according to claim 1, further comprising a venturi located downstream of the outlet.

7. In a subsea multiphase flow mixing apparatus for mixing a multiphase flow comprising at least a liquid phase and a gas phase, the apparatus comprising at least one container which is configured to be disposed subsea and a hollow flow regulating device which is axially arranged within the container, the container including at least one inlet for the multiphase flow and at least one outlet located at a lower axial end of the container, the flow regulating device comprising a lower first end located an axial distance from the outlet, a plurality of perforations extending along the axial length thereof and a discharge opening in the lower first end which opens towards the outlet, the lower first end of the flow regulating device and a top of the outlet defining an axially extending drainage gap having a drainage area, the improvement comprising a position adjustment device which is connected to the flow regulating device and is configured to selectively move the flow regulating device in the axial direction to selective stationary positions to thereby adjust the drainage area of the drainage gap.

8. The apparatus according to claim 7, wherein the position adjustment device is connected to an upper second end of the flow regulating device.

9. The apparatus according to claim 7, wherein during operation of the apparatus, the multiphase flow separates into at least the liquid phase and the gas phase in the container, and wherein the inlet and the outlet are arranged such that the liquid phase having the largest density separates at the lower axial end of the container, closest to the outlet.

10. The apparatus according to claim 7, wherein the container converges as an abutted cone at the outlet.

11. The apparatus according to claim 7, wherein the diameter of the flow regulating device is equal to the diameter of the outlet.

12. The apparatus according to any of claim 7, wherein the position adjustment device comprises an external interface arranged on the outside of the container which is configured to be manipulated by an ROV manipulator.

13. The apparatus according to claim 7, further comprising a venturi located downstream of the outlet.

* * * * *